US011230115B2

(12) United States Patent
Shinoda et al.

(10) Patent No.: US 11,230,115 B2
(45) Date of Patent: Jan. 25, 2022

(54) LIQUID EJECTING APPARATUS AND METHOD OF MAINTAINING LIQUID EJECTING APPARATUS

(71) Applicant: SEIKO EPSON CORPORATION, Tokyo (JP)

(72) Inventors: Tomoki Shinoda, Shiojiri (JP); Takeshi Iwamuro, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/919,342

(22) Filed: Jul. 2, 2020

(65) Prior Publication Data

US 2021/0001631 A1 Jan. 7, 2021

(30) Foreign Application Priority Data

Jul. 5, 2019 (JP) ..... JP2019-125876

(51) Int. Cl.

| | |
|---|---|
| ***B41J 2/18*** | (2006.01) |
| ***B41J 2/165*** | (2006.01) |
| ***B41J 2/175*** | (2006.01) |
| *B41J 2/14* | (2006.01) |

(52) U.S. Cl.

CPC ..... *B41J 2/18* (2013.01); *B41J 2/16523* (2013.01); *B41J 2/175* (2013.01); *B41J 2/17563* (2013.01); *B41J 2/14* (2013.01); *B41J 2002/14403* (2013.01)

(58) Field of Classification Search

CPC . B41J 2/18; B41J 2/175; B41J 2/16523; B41J 2/17563; B41J 2/14; B41J 2002/14403

See application file for complete search history.

(56) References Cited

U.S. PATENT DOCUMENTS

| | | | | |
|---|---|---|---|---|
| 10,538,100 | B2 * | 1/2020 | Fujikake | B41J 2/18 |
| 2009/0027469 | A1 | 1/2009 | Furukawa | |
| 2010/0315473 | A1 | 12/2010 | Matsushita et al. | |
| 2015/0015647 | A1 | 1/2015 | Kobayashi et al. | |
| 2017/0225481 | A1 | 8/2017 | Iwamuro et al. | |
| 2017/0225482 | A1 | 8/2017 | Shinoto et al. | |
| 2018/0093491 | A1 | 4/2018 | Murayama et al. | |
| 2019/0009563 | A1 | 1/2019 | Tokisawa et al. | |

FOREIGN PATENT DOCUMENTS

| | | |
|---|---|---|
| JP | H04-212864 A | 8/1992 |
| JP | H05-116332 A | 5/1993 |
| JP | 2004-025727 | 1/2004 |
| JP | 2009-028979 | 2/2009 |

(Continued)

*Primary Examiner* — Geoffrey S Mruk

(74) *Attorney, Agent, or Firm* — Workman Nydegger

(57) ABSTRACT

A liquid ejecting apparatus includes a liquid ejecting portion having a filter configured to filter a supplied liquid and eject the liquid filtered by the filter from nozzles, a liquid ejecting portion holding portion replaceably holding the liquid ejecting portion, a liquid supply flow channel coupled to the liquid ejecting portion so as to supply the liquid to the liquid ejecting portion, a flow mechanism configured to flow the liquid, and a control portion configured to drive the flow mechanism to cause the liquid to flow in the liquid supply flow channel toward the liquid ejecting portion in replacement of the liquid ejecting portion.

5 Claims, 8 Drawing Sheets

(56) References Cited

FOREIGN PATENT DOCUMENTS

| | | |
|---|---|---|
| JP | 2014-031017 | 2/2014 |
| JP | 2014-124946 | 7/2014 |
| JP | 2015-016567 | 1/2015 |
| JP | 2017-140737 | 8/2017 |
| JP | 2017-140739 | 8/2017 |
| JP | 2018-058255 | 4/2018 |
| JP | 2019-014253 | 1/2019 |

* cited by examiner

LIQUID EJECTING APPARATUS AND METHOD OF MAINTAINING LIQUID EJECTING APPARATUS

The present application is based on, and claims priority from JP Application Serial Number 2019-125876, filed Jul. 5, 2019, the disclosure of which is hereby incorporated by reference herein in its entirety.

BACKGROUND

1. Technical Field

The present disclosure relates to a liquid ejecting apparatus such as a printer and a method of maintaining the liquid ejecting apparatus.

2. Related Art

A liquid ejecting apparatus that discharges an ink, which is an example liquid, supplied from a main tank through a supply flow channel, which is an example liquid supply flow channel, from a head unit, which is an example liquid ejecting portion, for printing such as a recording apparatus is disclosed, for example, in JP-A-2019-14253. The head unit has a filter, and the head unit can be replaced.

In replacing the liquid ejecting portion, the filter is also replaced together with the liquid ejecting portion in a state in which the filter can collect foreign matter. Accordingly, foreign matter remains in the liquid supply flow channel, and thus the filter cannot efficiently collect the foreign matter.

SUMMARY

According to an aspect of the present disclosure, a liquid ejecting apparatus for solving the above-described problem includes a liquid ejecting portion having a filter configured to filter a supplied liquid and eject the liquid filtered by the filter from nozzles, a liquid ejecting portion holding portion replaceably holding the liquid ejecting portion, a liquid supply flow channel coupled to the liquid ejecting portion so as to supply the liquid to the liquid ejecting portion, a liquid return flow channel coupled to the liquid ejecting portion, the liquid return flow channel constituting a circulation flow channel together with the liquid supply flow channel, a flow mechanism configured to flow the liquid in the circulation flow channel, and a control portion configured to drive the flow mechanism to cause the liquid to flow in the liquid supply flow channel toward the liquid ejecting portion in replacement of the liquid ejecting portion.

A method of maintaining a liquid ejecting apparatus including a liquid ejecting portion having a filter configured to filter a supplied liquid and eject the liquid filtered by the filter from nozzles and a liquid supply flow channel coupled to the liquid ejecting portion so as to supply the liquid to the liquid ejecting portion is provided to solve the above-described problem. The method includes causing the liquid to flow in the liquid supply flow channel toward the liquid ejecting portion in replacement of the liquid ejecting portion.

DESCRIPTION OF EXEMPLARY EMBODIMENTS

First Embodiment

Figure 1:
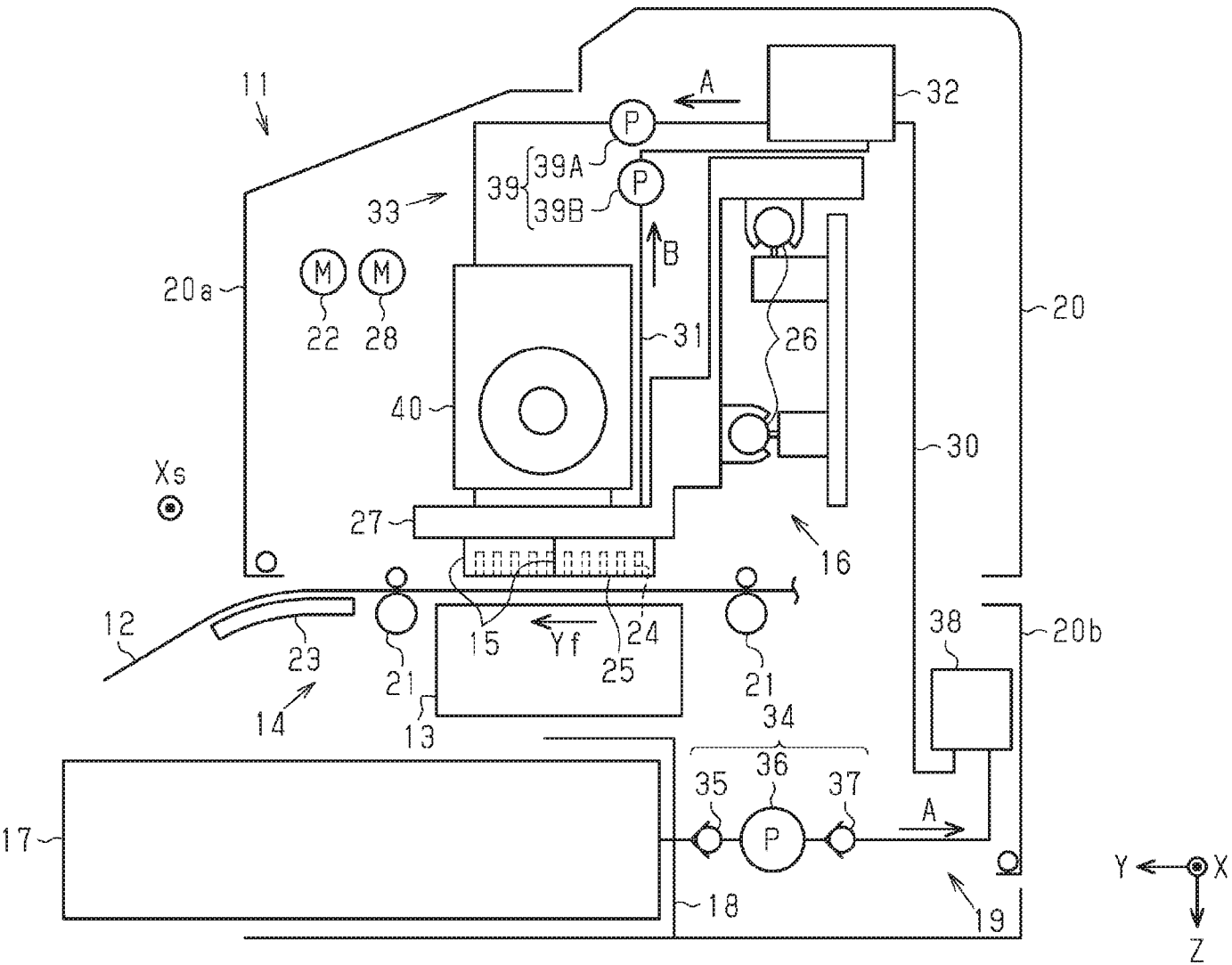
FIG. 1 is a side view schematically illustrating a liquid ejecting apparatus according to a first embodiment.

Hereinafter, a first embodiment of a liquid ejecting apparatus and a method of maintaining the liquid ejecting apparatus will be described with reference to the attached drawings. The liquid ejecting apparatus is, for example, an ink jet printer that prints by ejecting an ink, which is an example liquid, onto a medium such as paper.

In the drawings, it is assumed that a liquid ejecting apparatus 11 is placed on a horizontal plane, and the Z axis denotes the direction of gravity, and the X axis and the Y axis denote directions along the horizontal plane. The X axis, the Y axis, and the Z axis are orthogonal to each other. In the following description, a direction that is parallel to the Z axis is also referred to as a vertical direction Z.

As illustrated in FIG. 1, the liquid ejecting apparatus 11 may include a support base 13 that supports a medium 12, and a transport section 14 that transports the medium 12. The liquid ejecting apparatus 11 includes a liquid ejecting portion 15 and a moving mechanism 16. The liquid ejecting portion 15 ejects a liquid onto the medium 12 that is supported by the support base 13, and the moving mechanism 16 is configured to move the liquid ejecting portion 15 in a scanning direction Xs.

The liquid ejecting apparatus 11 may include an attachment section 18 and a liquid supply section 19. To the attachment section 18, a liquid supply source 17 containing a liquid is detachably attached. The liquid supply section 19 is configured to supply a liquid to the liquid ejecting portion 15. The liquid ejecting apparatus 11 may include a body 20 and a first cover **20*a* and a second cover 20*b*. The body 20 may include a housing and frames and the first cover 20*a* and the second cover 20*b* are openably and closably attached to the body 20**.

The support base 13, in the liquid ejecting apparatus 11, extends in the scanning direction Xs that is also a width direction of the medium 12. The scanning direction Xs according to the embodiment is a direction parallel to the X axis. The support base 13 supports the medium 12 that is in a print position.

The transport section 14 may include a transport roller pair 21 that nips and transports the medium 12, a transport motor 22 that rotates the transport roller pair 21, and a guide plate 23 that guides the medium 12. A plurality of transport roller pairs 21 may be disposed along a path for transporting the medium 12. The transport section 14 drives the transport motor 22 to transport the medium 12 along the front side of the support base 13. The transport section 14 transports the medium 12 in a transport direction Yf, which is a direction along the transport path of the medium 12 and a direction along the side of the support base 13 with which the medium 12 comes into contact. The transport direction Yf according to the embodiment is parallel to the Y axis at the print position.

The liquid ejecting apparatus 11 according to the embodiment has two liquid ejecting portions 15. The two liquid ejecting portions 15 are disposed at a predetermined distance from each other in the scanning direction Xs and disposed at a predetermined distance from each other in the transport direction Yf. The liquid ejecting portion 15 has a nozzle surface 25 that has nozzles 24. The liquid ejecting portion 15 according to the embodiment prints to the medium 12 by ejecting a liquid in the vertical direction Z onto the medium 12 located in the print position.

The moving mechanism 16 includes guide shafts 26 that extend in the scanning direction Xs, a liquid ejecting portion holding portion 27 that replaceably holds the liquid ejecting portions 15, and a carriage motor 28 that moves the liquid ejecting portion holding portion 27 along the guide shafts 26. The liquid ejecting portion holding portion 27 holds the liquid ejecting portions 15 such that the nozzle surfaces 25 face the support base 13 in the vertical direction Z. The first cover 20*a* may cover a part of the travel path of the liquid ejecting portions 15. The liquid ejecting apparatus 11 may be configured such that the opened first cover 20*a* exposes the liquid ejecting portion 15 to facilitate the replacement of the liquid ejecting portion 15.

The moving mechanism 16 reciprocates the liquid ejecting portion holding portion 27 and the liquid ejecting portions 15 along the guide shafts 26 in the scanning direction Xs and the direction opposite to the scanning direction Xs. More specifically, the liquid ejecting apparatus 11 according to the embodiment is a serial type apparatus that reciprocates the liquid ejecting portions 15 along the X axis.

The liquid supply source 17 is, for example, a container that stores a liquid therein. The liquid supply source 17 may be a replaceable cartridge or a tank that can be refilled with the liquid. The liquid ejecting apparatus 11 may include a plurality of liquid supply sections 19 that correspond to the types of liquid to be ejected from the liquid ejecting portions 15. The liquid ejecting apparatus 11 according to the embodiment has four liquid supply sections 19.

The liquid supply section 19 includes a liquid supply flow channel 30 that is coupled to the liquid ejecting portion 15 so as to supply a liquid to the liquid ejecting portion 15. The liquid supply section 19 may include a liquid return flow channel 31 that is coupled to the liquid ejecting portion 15 and a storage portion 32 that stores a liquid. The liquid return flow channel 31 and the liquid supply flow channel 30 may constitute a circulation flow channel 33. The storage portion 32 may be coupled to the liquid supply flow channel 30 and the liquid return flow channel 31 to constitute a circulation flow channel 33.

The liquid supply section 19 may include an outlet pump 34 that supplies a liquid from the liquid supply source 17. The outlet pump 34 may include a suction valve 35, a positive displacement pump 36, and a discharge valve 37. The suction valve 35 is disposed upstream the positive displacement pump 36 in a supply direction A in the liquid supply flow channel 30. The discharge valve 37 is disposed downstream the outlet pump 34 in the supply direction A in the liquid supply flow channel 30. The suction valve 35 and the discharge valve 37 allow a liquid to flow from upstream to downstream in the liquid supply flow channel 30, and prevent the liquid from flowing from downstream to upstream.

The liquid supply section 19 may include a filter unit 38 that catches bubbles and foreign matter in a liquid. The filter unit 38 catches bubbles and foreign matter in a liquid. The filter unit 38 may be detachably attached to the liquid supply flow channel 30. The liquid ejecting apparatus 11 may be configured such that the opened second cover 20*b* exposes the filter unit 38 to facilitate the replacement of the filter unit 38.

The liquid supply section 19 includes a flow mechanism 39 that is configured to flow a liquid in the circulation flow channel 33 and a pressure regulator 40 that regulates the pressure of a liquid to be supplied to the liquid ejecting portion 15. The flow mechanism 39 may include a supply pump 39A that is disposed in the liquid supply flow channel 30 and a return pump 39B that is disposed in the liquid return flow channel 31. The supply pump 39A forces a liquid to flow in the supply direction A from the storage portion 32 along the liquid supply flow channel 30 toward the liquid ejecting portion 15. The return pump 39B forces a liquid to flow in a return direction B from the liquid ejecting portion 15 along the liquid return flow channel 31 toward the storage portion 32. The flow mechanism 39 may include one of the supply pump 39A and the return pump 39B.

Figure 2:
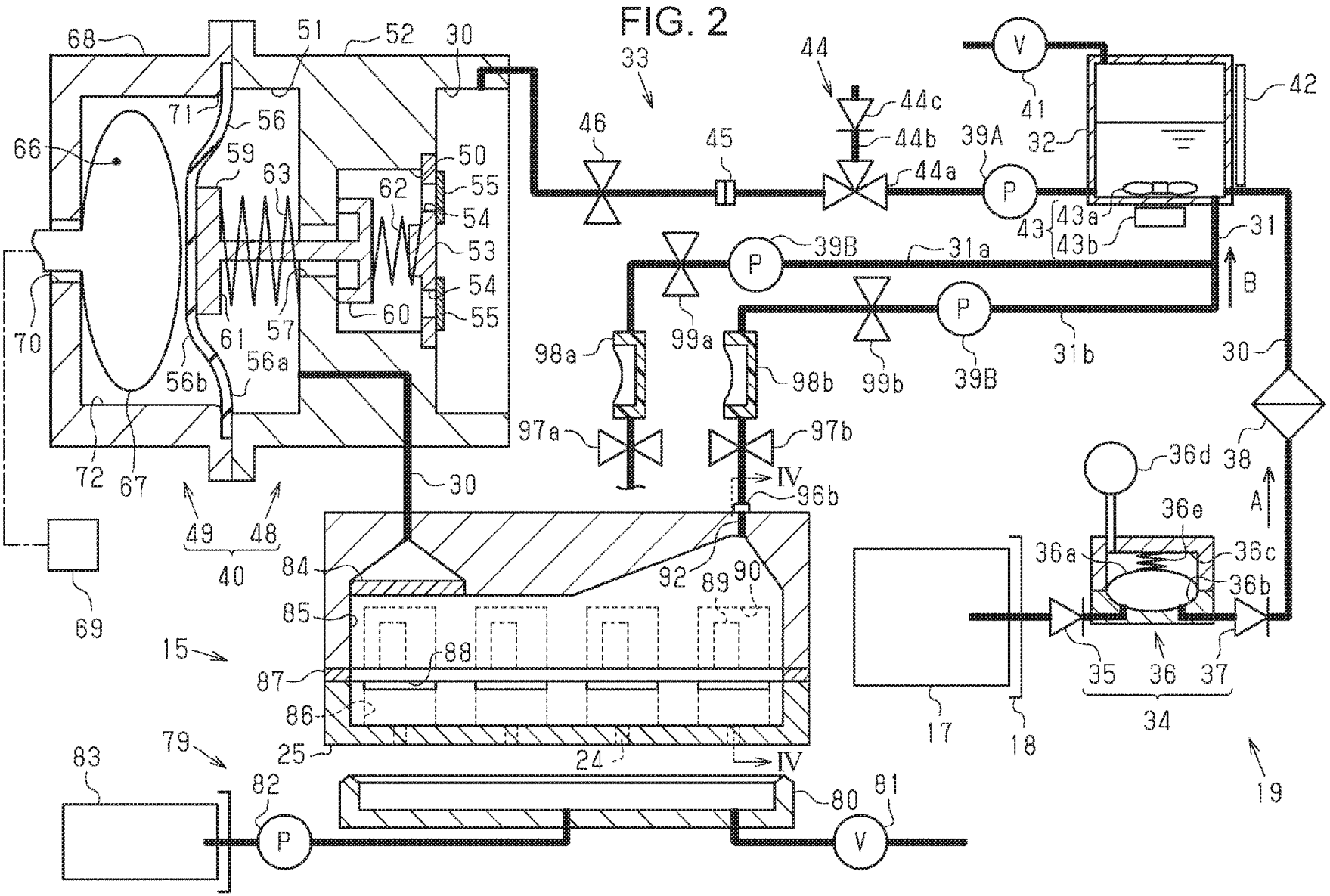
FIG. 2 is a cross-sectional view schematically illustrating a liquid ejecting portion and a liquid supply portion.

As illustrated in FIG. 2, the positive displacement pump 36 includes a pump chamber 36*b* and a negative-pressure chamber 36*c* that are partitioned by a flexible member 36*a*. The positive displacement pump 36 includes a decompression portion 36*d* that reduces the pressure in the negative-pressure chamber 36*c*, and a pressing member 36*e* that is disposed in the negative-pressure chamber 36*c* and presses the flexible member 36*a* against the pump chamber 36*b*.

The outlet pump 34 sucks the liquid from the liquid supply source 17 through the suction valve 35 as the volume in the pump chamber 36*b* increases. The outlet pump 34 presses the liquid in the pump chamber 36*b* with the pressing member 36*e* that presses the liquid through the flexible member 36*a*. The outlet pump 34 discharges the liquid through the discharge valve 37 toward the liquid ejecting section 15 as the volume in the pump chamber 36*b* decreases. The pressure to the liquid to be applied by the outlet pump 34 depends on a pressing force of the pressing member 36*e*.

The liquid supply section 19 may include a storage release valve 41 that opens the space in the storage portion 32 to the atmosphere, a storage amount detecting portion 42 that detects an amount of the liquid stored in the storage portion 32, and a stirring mechanism 43 that is configured to stir the liquid in the storage portion 32. The stirring mechanism 43 may include a stirring member 43*a* disposed in the storage portion 32, and a rotation portion 43*b* that rotates the stirring member 43*a*.

The liquid supply section 19 may include an air intake portion 44 that takes in air to the liquid supply flow channel 30. The air intake portion 44 includes a switching valve 44*a* that is disposed in the liquid supply flow channel 30, an air flow channel 44*b* that is coupled to the switching valve 44*a*, and a one-way valve 44*c* that is disposed in the air flow channel 44*b*. The switching valve 44*a* may be a three-way valve to switch turning on the flow and turning off the flow between the liquid supply flow channel 30 and the air flow channel 44*b*. The one-way valve 44*c* allows the air that flows toward the liquid supply flow channel 30 and regulates the fluid that flows from the liquid supply flow channel 30 to the outside. The liquid supply flow channel 30 communicating with the air flow channel 44*b* allows the air to be taken in the liquid supply flow channel 30 through the air flow channel 44*b*.

The liquid supply section 19 may include a supply connector 45 and a supply valve 46 that are disposed in the liquid supply flow channel 30. The supply connector 45 couples the liquid supply flow channel 30 that is upstream the supply connector 45 and the liquid supply flow channel 30 that is downstream in a separable manner. The supply valve 46 is closed when the liquid supply flow channel 30 is separated by disconnecting the supply connector 45.

Next, the pressure regulator 40 will be described. As illustrated in FIG. 2, the pressure regulator 40 may include a pressure regulating mechanism 48 that is a part of the liquid supply flow channel 30, and a pressing mechanism 49 that presses the pressure regulating mechanism 48. The pressure regulating mechanism 48 includes a liquid inflow portion 50 into which the liquid supplied from the liquid supply source 17 through the liquid supply flow channel 30 flows, and a body portion 52 that has a liquid outflow portion 51 configured to store the liquid therein.

The liquid supply flow channel 30 and the liquid inflow portion 50 are partitioned by a wall 53 of the body portion 52 and communicate with each other via through holes 54 in the wall 53. The through hole 54 is covered with a filter member 55. Accordingly, the liquid in the liquid supply flow channel 30 is filtered by the filter member 55 and flows into the liquid inflow portion 50.

In the liquid outflow portion 51, at least a part of a wall functions as a diaphragm 56. The diaphragm 56 receives the pressure of the liquid in the liquid outflow portion 51 on a first surface 56*a* that is an inner surface of the liquid outflow portion 51. The diaphragm 56 receives atmospheric pressure on a second surface 56*b* that is an outer surface of the liquid outflow portion 51. With this structure, the diaphragm 56 deforms according to the pressure in the liquid outflow portion 51. The volume of the liquid outflow portion 51 changes as the diaphragm 56 deforms. The liquid inflow portion 50 and the liquid outflow portion 51 communicate with each other through a communication flow channel 57.

The pressure regulating mechanism 48 includes an on-off valve 59 that is configured to switch a valve-closed state in which the liquid inflow portion 50 and the liquid outflow portion 51 are shut off and a valve-opened state in which the liquid inflow portion 50 and the liquid outflow portion 51 communicate with each other in the communication flow channel 57. The on-off valve 59 illustrated in FIG. 2 is in the valve-closed state. The on-off valve 59 includes a valve portion 60 that is configured to shut off the communication flow channel 57 and a pressure-receiving portion 61 that receives the pressure from the diaphragm 56. The on-off valve 59 is moved when the pressure-receiving portion 61 is pressed by the diaphragm 56.

The liquid inflow portion 50 includes an upstream pressing member 62 therein. The liquid outflow portion 51 includes a downstream pressing member 63 therein. The upstream pressing member 62 and the downstream pressing member 63 press the on-off valve 59 in a direction to close the on-off valve 59. The on-off valve 59 is switched from the valve-closed state into the valve-opened state when the pressure applied to the first surface 56*a* is lower than the pressure applied to the second surface 56*b* and a difference between the pressure applied to the first surface 56*a* and the pressure applied to the second surface 56*b* is greater than or equal to a predetermined value. The predetermined value is, for example, one kilopascal (1 kPa).

The predetermined value is determined by a pressing force of the upstream pressing member 62, a pressing force of the downstream pressing member 63, a force required to deform the diaphragm 56, a sealing load that is a pressing force required to shut off the communication flow channel 57 with the valve portion 60, a pressure in the liquid inflow portion 50 exerted on the front surface of the valve portion 60, and a pressure in the liquid outflow portion 51. More specifically, as the pressing forces of the upstream pressing member 62 and the downstream pressing member 63 increase, the predetermined value for changing from the valve-closed state to the valve-opened state increases.

The pressing forces of the upstream pressing member 62 and the downstream pressing member 63 are set such that the pressure in the liquid outflow portion 51 is a negative pressure within a range in which a meniscus can be formed at the gas-liquid interface in each nozzle 24. For example, when atmospheric pressure is exerted on the second surface 56*b*, pressing forces of the upstream pressing member 62 and the downstream pressing member 63 are set such that the pressure in the liquid outflow portion 51 becomes −1 kPa. In such a case, the gas-liquid interface is an interface between the liquid and the gas, and the meniscus is a curved liquid surface that is formed by the liquid and the nozzle 24 that are in contact with each other. In the nozzle 24, it is preferable that a concave meniscus that is suitable for liquid ejection be formed.

In the pressure regulating mechanism 48 according to the embodiment, when the on-off valve 59 is in the valve-closed state, the pressure of the liquid upstream the pressure regulating mechanism 48 is regulated to a positive pressure by the outlet pump 34. More specifically, when the on-off valve 59 is in the valve-closed state, the pressures of the liquid in the liquid inflow portion 50 and upstream the liquid inflow portion 50 are regulated to positive pressures by the outlet pump 34.

In the pressure regulating mechanism 48 according to the embodiment, when the on-off valve 59 is in the valve-closed state, the pressure of the liquid downstream the pressure regulating mechanism 48 is regulated to a negative pressure by the diaphragm 56. More specifically, when the on-off valve 59 is in the valve-closed state, the pressures of the liquid in the liquid outflow portion 51 and downstream the liquid outflow portion 51 are regulated to negative pressures by the diaphragm 56.

When the liquid ejecting portion 15 ejects the liquid, the liquid stored in the liquid outflow portion 51 is supplied to the liquid ejecting portion 15 through the liquid supply flow channel 30. With this operation, the pressure in the liquid outflow portion 51 decreases. By the decrease in pressure, when the difference between the pressure exerted on the first surface 56*a* and the pressure exerted on the second surface 56*b* in the diaphragm 56 becomes greater than or equal to a predetermined value, the diaphragm 56 bends and deforms in a direction to decrease the volume of the liquid outflow portion 51. As the diaphragm 56 deforms, the pressure receiving portion 61 is pressed and moved to open the on-off valve 59.

When the on-off valve 59 is opened, since the liquid in the liquid inflow portion 50 is pressurized by the outlet pump 34, the liquid is supplied from the liquid inflow portion 50 to the liquid outflow portion 51. With this operation, the pressure in the liquid outflow portion 51 increases. The pressure increase in the liquid outflow portion 51 deforms the diaphragm 56 to increase the volume of the liquid outflow portion 51. The on-off valve 59 is switched from the valve-opened state into the valve-closed state when a difference between the pressure applied to the first surface 56*a* and the pressure applied to the second surface 56*b* in the diaphragm 56 is lower than the predetermined value. As a result, the on-off valve 59 prevents the liquid from flowing from the liquid inflow portion 50 toward the liquid outflow portion 51.

As described above, the pressure regulating mechanism 48 adjusts the pressure of the liquid supplied to the liquid ejecting portion 15 by deforming the diaphragm 56, and thereby regulates the pressure in the liquid ejecting portion 15 that is a back pressure to the nozzles 24.

The pressing mechanism 49 includes an expansion and contraction portion 67 that forms a pressure regulating chamber 66 on the second surface 56*b* side of the diaphragm 56, a pressing member 68 that presses the expansion and contraction portion 67, and a pressure regulating portion 69 that regulates the pressure in the pressure regulating chamber 66. For example, the expansion and contraction portion 67 is made of rubber or resin formed in a balloon shape. The expansion and contraction portion 67 expands or contracts depending on the pressure in the pressure regulating chamber 66 adjusted by the pressure regulating portion 69. The pressing member 68 has, for example, a cylindrical shape with a bottom. Into an insertion hole 70 formed in the bottom of the pressing member 68, a part of the expansion and contraction portion 67 is inserted.

Edge portions of the pressing member 68 of an inner surface on the sides of an opening 71 are rounded. The pressing member 68 is mounted to the pressure regulating mechanism 48 such that the opening 71 is blocked by the pressure regulating mechanism 48. With this structure, the pressing member 68 has an air chamber 72 over the second surface 56*b* of the diaphragm 56. The inside of the air chamber 72 is subjected to atmospheric pressure. Accordingly, atmospheric pressure is exerted on the second surface 56*b* of the diaphragm 56.

The pressure regulating portion 69 adjusts the pressure in the pressure regulating chamber 66 to a pressure higher than the atmospheric pressure, which is the pressure in the air chamber 72, to expand the expansion and contraction portion 67. The pressure regulating portion 69 expands the expansion and contraction portion 67 and thereby the pressing mechanism 49 presses the diaphragm 56 in a direction to decrease the volume of the liquid outflow portion 51. In this operation, the expansion and contraction portion 67 of the pressing mechanism 49 presses a portion of the diaphragm 56 with which the pressure receiving portion 61 is in contact. The area of the portion of the diaphragm 56 with which the pressure receiving portion 61 is in contact is larger than the cross-sectional area of the communication flow channel 57.

Figure 3:
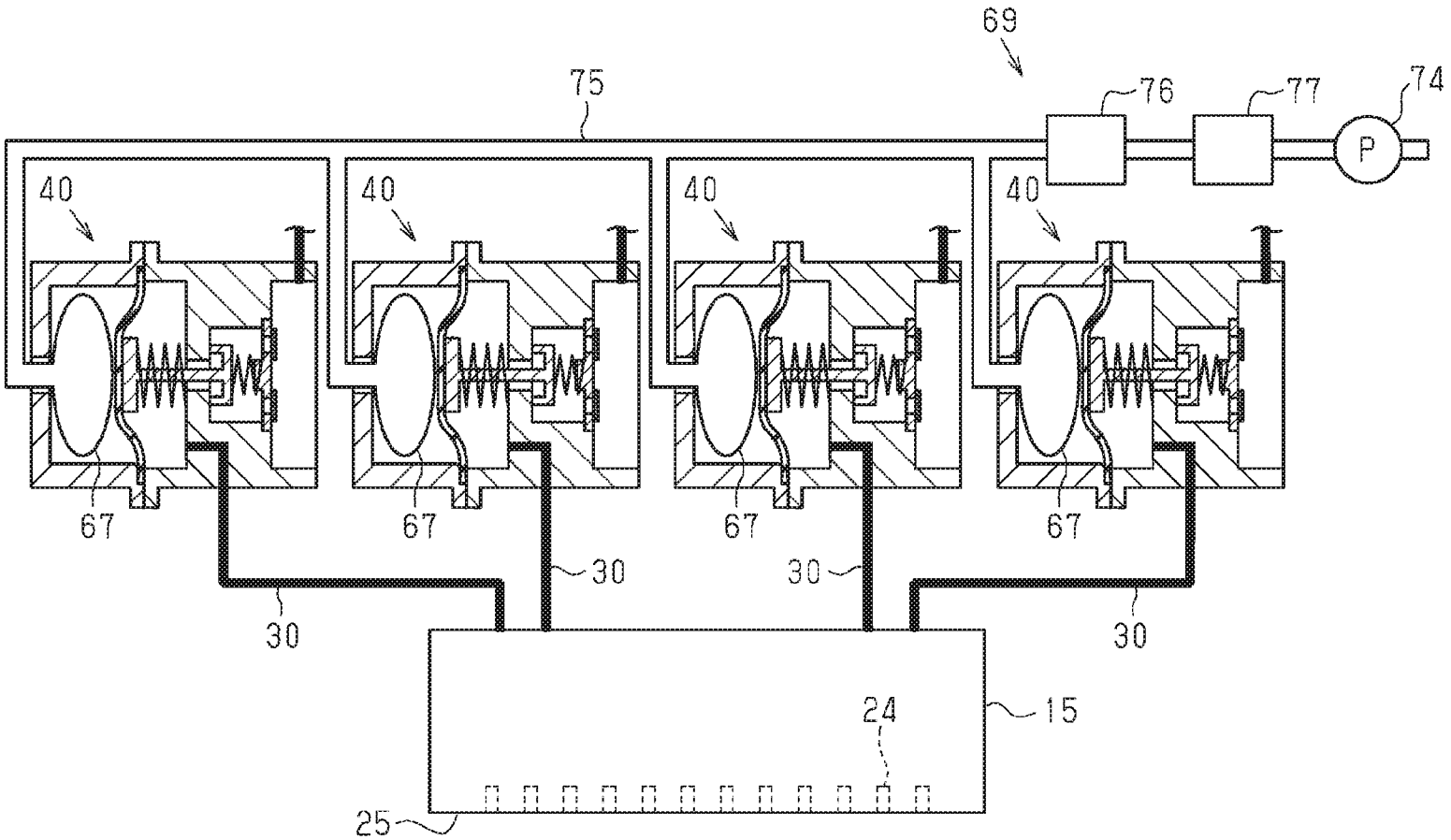
FIG. 3 is a cross-sectional view schematically illustrating pressure regulators and a pressure regulating portion.

As illustrated in FIG. 3, the pressure regulating portion 69 includes, for example, a pressure pump 74 that presses a fluid such as air or water, and a coupling channel 75 that couples the pressure pump 74 and the expansion and contraction portions 67. The pressure regulating portion 69 includes a pressure detecting portion 76 that detects a pressure of a fluid in the coupling channel 75, and a fluid pressure regulating portion 77 that adjusts the pressure in the coupling channel 75.

The coupling channel 75 is divided into a plurality of branches and the branches are each coupled to corresponding expansion and contraction portions 67 of the pressure regulators 40. The coupling channel 75 according to the embodiment is divided into four branches and the branches are coupled to the expansion and contraction portions 67 of the four pressure regulators 40 respectively. The fluid pressurized by the pressure pump 74 is supplied to the expansion and contraction portions 67 through the coupling channel 75. At the branched portions in the coupling channel 75, valves for switching on and off of the flow channel may be disposed. With these valves, by controlling the valves, the pressurized fluid can be selectively supplied to the expansion and contraction portions 67.

The fluid pressure regulating portion 77 may be, for example, a relief valve. The fluid pressure regulating portion 77 is designed to automatically open when the pressure of the fluid in the coupling channel 75 becomes higher than a predetermined pressure. The opened fluid pressure regulating portion 77 releases the fluid in the coupling channel to the outside. With this structure, the fluid pressure regulating portion 77 decreases the pressure of the fluid in the coupling channel 75.

As illustrated in FIG. 2, the liquid ejecting apparatus 11 may include a maintenance section 79 that performs maintenance of the liquid ejecting portion 15. The maintenance section 79 may include a cap 80 for capping the nozzle surface 25 of the liquid ejecting portion 15, a cap open valve 81 that opens the inside of the cap 80 to the atmosphere, a suction pump 82 that sucks the inside of the cap 80, and a waste liquid tank 83 that stores waste liquid.

The cap 80 moves relative to the liquid ejecting portion 15 and performs capping. In the capping, the cap 80 comes into contact with the liquid ejecting portion 15 to form a space for the nozzles 24 to open. The cap 80 performs the capping to the nozzle surface 25 to suppress thickening of the liquid in the nozzles 24 due to drying.

In capping the nozzle surface 25, the cap 80 may form a sealed space to prevent the fluid such as gas and liquid from flowing into and out of the cap 80. With the space, in capping, drying of the liquid in the nozzles 24 can be further suppressed.

The cap open valve 81 is opened with the cap 80 capping the liquid ejecting section 15 to allow the inside of the cap 80 to communicate with the atmosphere outside the cap 80.

The maintenance section 79 may include a plurality of caps 80 to correspond to the number of liquid ejecting portions 15. The maintenance section 79 according to the embodiment includes two caps 80. The two caps 80 perform capping to two liquid ejecting portions 15 respectively.

The suction pump 82 is driven with the caps 80 capping the liquid ejecting portions 15 to produce a negative pressure in the nozzles 24 to force the liquid out of the nozzles 24. This maintenance operation is also referred to as suction cleaning. The waste liquid tank 83 stores the liquid discharged by the suction cleaning as a waste liquid. The waste liquid tank 83 may be a replaceable component.

Next, the liquid ejecting portion 15 and the liquid return flow channel 31 that is coupled to the liquid ejecting portion 15 will be described. As illustrated in FIG. 2, the liquid ejecting portion 15 includes a filter 84 that filters a supplied liquid, and ejects the liquid filtered by the filter 84 from the nozzles 24. The filter 84 catches bubbles, foreign matter, and the like in a supplied liquid. The filter 84 may be disposed in a common liquid chamber 85 to which the liquid supply flow channel 30 is coupled.

The liquid ejecting portion 15 has pressure chambers 86 that communicate with the common liquid chamber 85. One nozzle 24 is provided for one pressure chamber 86. A part of a wall surface of the pressure chamber 86 is a vibrating plate 87. The common liquid chamber 85 and the pressure chambers 86 communicate with each other through a supply communication channel 88.

The liquid ejecting portion 15 includes actuators 89 and housing chambers 90 that house the actuators 89. The housing chambers 90 are disposed at positions different from the common liquid chamber 85. One housing chamber 90 houses one actuator 89. The actuator 89 is disposed on a side of the vibrating plate 87 opposite to a portion that faces the pressure chamber 86. The liquid ejecting portion 15 ejects the liquid in the pressure chambers 86 as liquid droplets from the nozzles 24 by the drive of the driven actuators 89.

The actuator 89 according to the embodiment comprises a piezoelectric element that contracts when a drive voltage is applied. After the vibrating plate 87 is deformed by the contractions of the actuators 89 with the application of the drive voltage, the application of the drive voltage to the actuators 89 is stopped, and then the liquid in the pressure chambers 86 in which the volume is changed is discharged from the nozzles 24 as liquid droplets.

Figure 4:
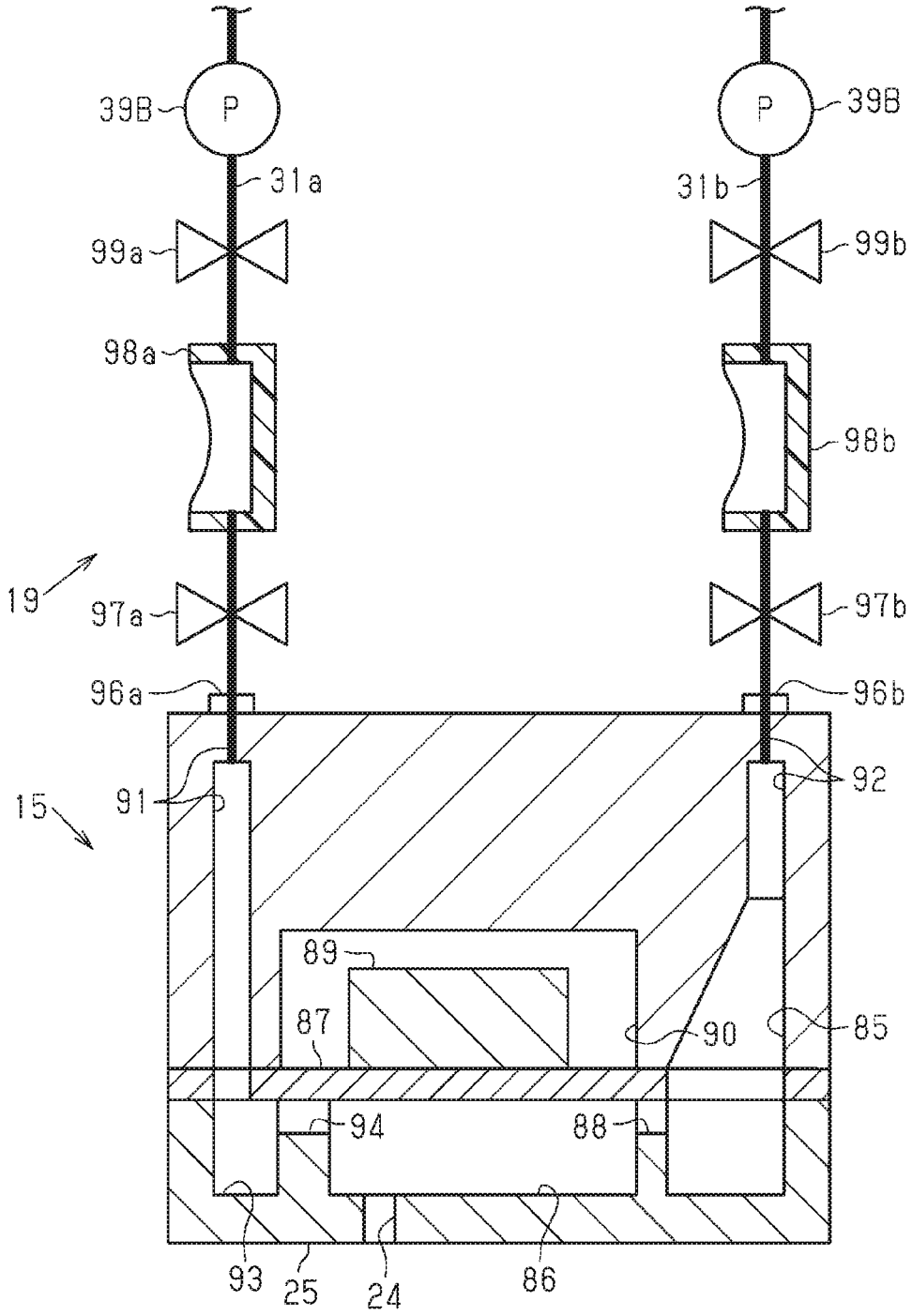
FIG. 4 is a cross-sectional view taken along the line IV-IV in FIG. 2.

As illustrated in FIG. 4, the liquid ejecting portion 15 may have a first discharge flow channel 91 and a second discharge flow channel 92 that discharge a supplied liquid to the outside without passing the liquid through the nozzles 24 and a discharge liquid chamber 93 that couples the first discharge flow channel 91 and the pressure chamber 86.

The discharge liquid chamber 93 communicates with the pressure chambers 86 through discharge communication flow channels 94 that are each provided for the pressure chambers 86. The discharge liquid chamber 93 requires only one first discharge flow channel 91 for a plurality of pressure chambers 86. Accordingly, with the discharge liquid chamber 93, it is not necessary to provide the first discharge flow channel 91 for each pressure chamber 86. This structure simplifies the structure of the liquid ejecting portion 15. The liquid ejecting portion 15 may have a plurality of first discharge flow channels 91 that communicate with a plurality of pressure chambers 86.

As illustrated in FIG. 2 and FIG. 4, the liquid return flow channel 31 may have a first return flow channel 31*a* that is coupled to the first discharge flow channel 91 and a second return flow channel 31*b* that is coupled to the second flow channel 92. The first return flow channel 31*a* and the second return flow channel 31*b* of the liquid return flow channel 31 according to the embodiment merge together. Alternatively, each of the first return flow channel 31*a* and the second return flow channel 31*b* of the liquid return flow channel 31 according to the embodiment may be directly coupled to the storage portion 32 without merging together.

The first return flow channel 31*a* may have a first return connector 96*a*, a first replacement valve 97*a*, a first damper 98*a*, and a first return valve 99*a*. The second return flow channel 31*b* may have a second return connector 96*b*, a second replacement valve 97*b*, a second damper 98*b*, and a second return valve 99*b*. The return pump 39B may be disposed in each of the first return flow channel 31*a* and the second return flow channel 31*b*, or one return pump 39B may be disposed in the liquid return flow channel 31 between the junction of the first return flow channel 31*a* and the second return flow channel 31*b* and the storage portion 32.

The first return connector 96*a* couples the first return flow channel 31*a* to the first discharge flow channel 91 in a separable manner. The second return connector 96*b* couples the second return flow channel 31*b* to the second discharge flow channel 92 in a separable manner.

In the first return flow channel 31*a*, the first replacement valve 97*a* is disposed between the first return connector 96*a* and the first damper 98*a*. In the second return flow channel 31*b*, the second replacement valve 97*b* is disposed between the second return connector 96*b* and the second damper 98*b*. The first replacement valve 97*a* and the second replacement valve 97*b* are closed when the liquid ejecting portion 15 and the liquid supply section 19 are separated from each other.

The first damper 98*a* and the second damper 98*b* are configured to store a liquid. For example, a first side of the first damper 98*a* comprises a flexible film such that the volume varies to store a liquid. The first damper 98*a* and the second damper 98*b* suppress the variation of the pressure in the liquid ejecting portion 15 caused by the liquid flowing through the first return flow channel 31*a* and the second return flow channel 31*b*.

In the first return flow channel 31*a*, the first return valve 99*a* is disposed between the return pump 39B and the first damper 98*a*. In the second return flow channel 31*b*, the second return valve 99*b* is disposed between the return pump 39B and the second damper 98*b*. In the liquid supply section 19, the first return valve 99*a* or the second return valve 99*b* may be opened or closed to cause the liquid to flow in one of the first return flow channel 31*a* and the second return flow channel 31*b*.

Figure 5:
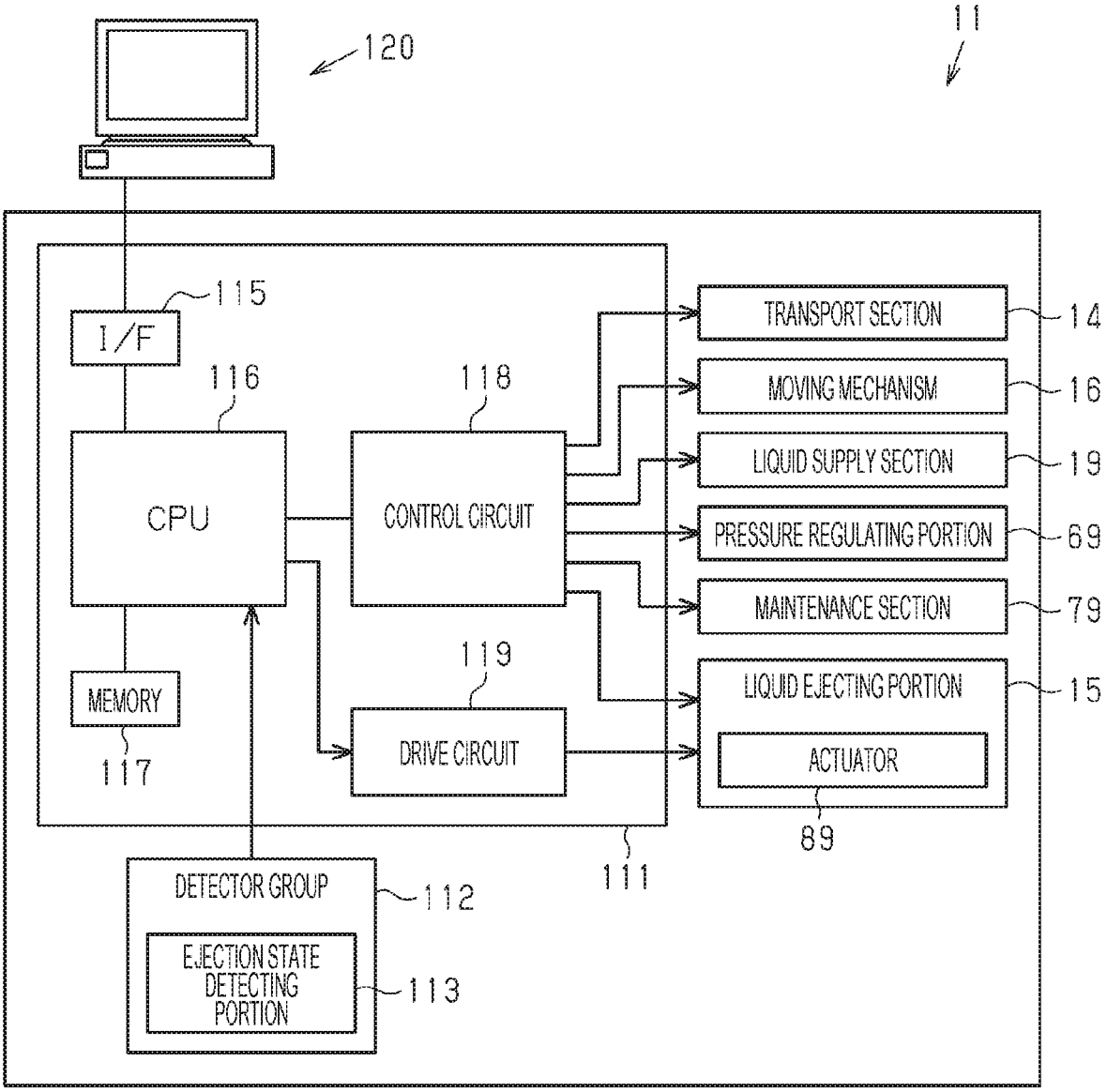
FIG. 5 is a block diagram illustrating an electric configuration of a liquid ejecting apparatus.

Next, an electrical configuration of the liquid ejecting apparatus 11 will be described. As illustrated in FIG. 5, the liquid ejecting apparatus 11 includes a control portion 111 that performs overall control of the components of the liquid ejecting apparatus 11 and a detector group 112 that is controlled by the control portion 111. The detector group 112 includes an ejection state detecting portion 113 that detects an oscillatory waveform in the pressure chamber 86 to detect an ejection state of the liquid in the liquid ejecting portion 15. The detector group 112 monitors a state in the liquid ejecting apparatus 11. The detector group 112 outputs the detection results to the control portion 111.

The control portion 111 includes an interface portion 115, a central processing unit (CPU) 116, a memory 117, a control circuit 118, and a drive circuit 119. The interface portion 115 transmits and receives data between a computer 120, which is an external device, and the liquid ejecting apparatus 11. The drive circuit 119 produces a drive signal for driving the actuators 89.

The CPU 116 is a processor. The memory 117 is a storage device that provides a region for storing programs or a work area for the CPU 116, and has a storage such as a random access memory (RAM) or an electrically erasable and programmable read-only memory (EEPROM). The CPU 116 controls mechanisms in the liquid ejecting apparatus 11 according to a program stored in the memory 117 with the control circuit 118.

The detector group 112 may include, for example, a linear encoder that detects a movement of the liquid ejecting portion holding portion 27 and a medium detection sensor that detects a medium 12. The ejection state detecting portion 113 may be a circuit that detects a residual vibration in the pressure chamber 86. The control portion 111 performs nozzle check, which will be described later, based on a result of the detection by the ejection state detecting portion 113. The ejection state detecting portion 113 may include a piezoelectric element that functions as the actuator 89.

Next, the nozzle check will be described. When a voltage is applied to the actuator 89 in accordance with a signal from the drive circuit 119, the vibrating plate 87 deforms. The deformation causes pressure variations in the pressure chamber 86. The variations cause the vibrating plate 87 to vibrate for a while. The vibration is referred to as residual vibration. Detecting a state of a pressure chamber 86 and a nozzle 24 communicating with the pressure chamber 86 is referred to as the nozzle check.

Figure 6:
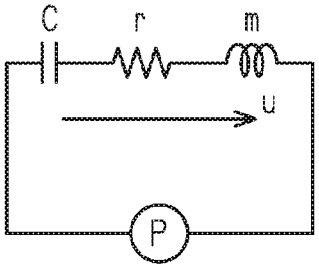
FIG. 6 illustrates a calculation model of simple harmonic motion assuming a residual vibration of a vibrating plate.

FIG. 6 illustrates a calculation model of simple harmonic motion assuming a residual vibration of the vibrating plate 87. The drive circuit 119 applies a drive signal to the actuator 89, and the actuator 89 expands and contracts in accordance with the voltage of the drive signal. The vibrating plate 87 deforms in accordance with the expansion and contraction of the actuator 89. By the deformation, the volume of the pressure chamber 86 increases and then decreases. The pressure in the pressure chamber 86 caused by the expansion and contraction causes a part of the liquid in the pressure chamber 86 to be ejected from the nozzle 24 as liquid droplets.

In a series of operation of the vibrating plate 87, the vibrating plate 87 freely oscillates at a natural frequency that is defined by the shape of the flow channel through which the liquid flows, the flow channel resistance r given by the liquid viscosity and other factors, the inertance m given by the liquid weight in the flow channel, and the compliance C of the vibrating plate 87. The free oscillation of the vibrating plate 87 is the residual vibration.

Figure 7:
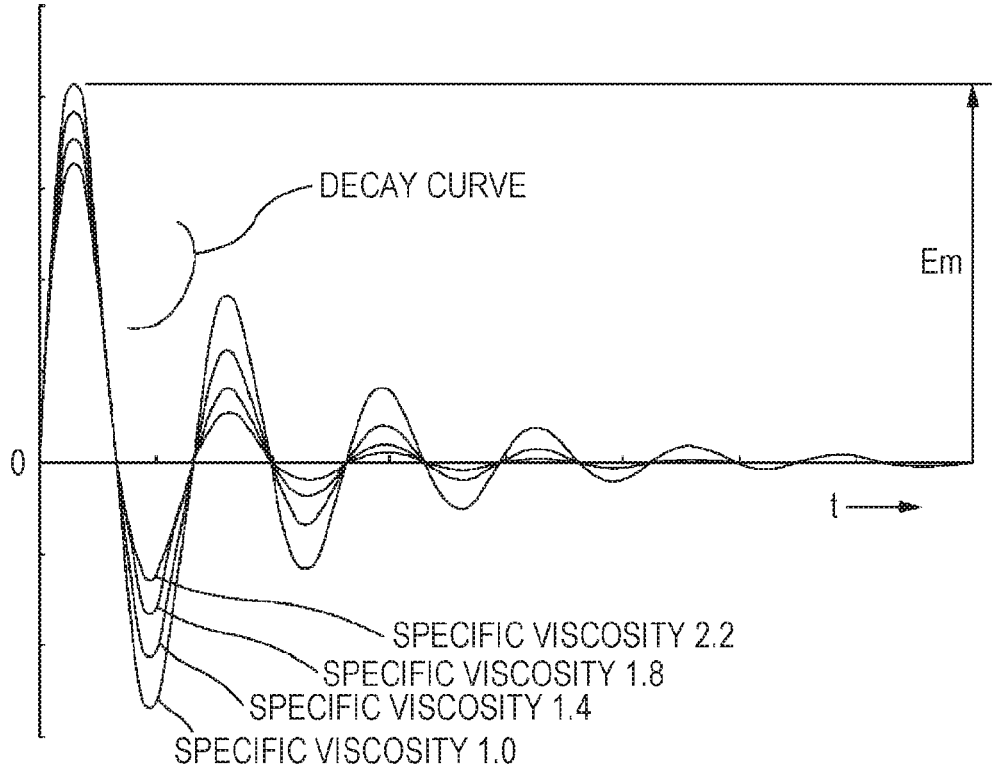
FIG. 7 illustrates a relationship between liquid thickening and residual vibration waveforms.

The calculation model for the residual vibration of the vibrating plate 87 illustrated in FIG. 7 is represented by the pressure P, the above-described inertance m, the compliance C, and the flow channel resistance r. A calculation for a step response with respect to a volume velocity u with the pressure P applied to the circuit in FIG. 6 leads to the following expression.

$$u = \frac{P}{\omega \cdot m} e^{-\omega t} \cdot \sin \omega t \tag{1}$$

$$\omega = \sqrt{\frac{1}{m \cdot C} - \alpha^2} \tag{2}$$

$$\alpha = \frac{r}{2m} \tag{3}$$

FIG. 7 illustrates a relationship between liquid thickening and residual vibration waveforms. In FIG. 7, the horizontal axis indicates time, and the vertical axis indicates the magnitude of residual vibration. For example, drying of the liquid around the nozzles 24 increases the viscosity of the liquid, that is, the liquid thickens. The thickened liquid increases the flow channel resistance r, increasing attenuation in the period of vibration and residual vibration.

Figure 8:
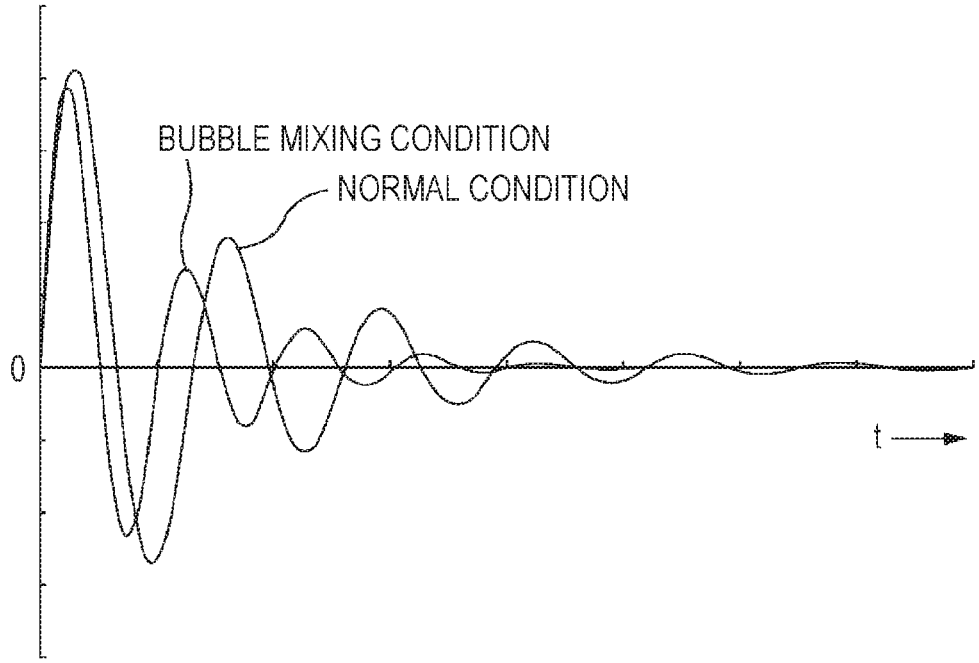
FIG. 8 illustrates a relationship between bubble mixing and a residual vibration waveform.

FIG. 8 illustrates a relationship between bubble mixing and a residual vibration waveform. In FIG. 8, the horizontal axis indicates time, and the vertical axis indicates the magnitude of residual vibration. For example, bubbles mixed into the liquid flow channel or ends of the nozzles 24 decrease the inertance m, which is a liquid weight, by the amount of the mixed bubbles as compared with an inertance m in a state in which the nozzles 24 are in a normal condition. According to the equation 2, a decreased inertance m increases the angular velocity ω, decreasing the period of vibration. In other words, the vibration frequency increases.

Furthermore, foreign matter such as paper powder adhering to around the openings of the nozzles 24 will increase the liquid in the pressure chambers 86 viewed from the vibrating plate 87 and seeped liquid as compared to those in normal conditions, resulting in an increased inertance m. Fibers of the paper powder adhering to around the outlets of the nozzles 24 will increase the flow channel resistance r. Accordingly, when paper powder adheres to around the openings of the nozzles 24, the frequency is lower than that in a normal ejection and the frequency of the residual vibration is higher than that in a liquid thickening.

Liquid thickening, mixing of bubbles, or adhesion of foreign matter will cause abnormal conditions in the nozzles 24 and the pressure chambers 86, and typically, the liquid is not ejected from the nozzles 24. The abnormal conditions will cause missing dots in an image recorded on the medium 12. In some cases, the amount of liquid droplets ejected from the nozzles 24 is small, or the liquid droplets are ejected in different directions and land on points different from target points. The nozzles 24 that cause such ejection failures are called abnormal nozzles.

As described above, the residual vibration in a pressure chamber 86 that communicates with an abnormal nozzle is different from the residual vibration in a pressure chamber 86 that communicates with a normal nozzle 24. Accordingly, the ejection state detecting portion 113 detects an oscillatory waveform of the pressure chambers 86 to detect a state in the pressure chambers 86. The control portion 111 performs the nozzle check based on a result of the detection from the ejection state detecting portion 113.

Based on the oscillatory waveform of the pressure chambers 86, which is a detection result from the ejection state detecting portion 113, the control portion 111 may determine whether the ejection state in the liquid ejecting portion 15 is normal or abnormal. When the pressure chamber 86 is in an abnormal state, the control portion 111 may determine that the nozzle 24 that communicates with the pressure chamber 86 is an abnormal nozzle. Based on the oscillatory waveform of the pressure chambers 86, the control portion 111 may determine whether the pressure chambers 86 are in an abnormal condition due to the presence of bubbles or the pressure chambers 86 are in an abnormal state due to liquid thickening. Based on the oscillatory waveform of the pressure chambers 86, the control portion 111 may determine a total volume of bubbles in the pressure chambers 86 and the nozzles 24 that communicate with the pressure chambers 86, or the extent of liquid thickening in the pressure chambers 86 and the nozzles 24 that communicate with the pressure chambers 86.

The frequency of an oscillatory waveform detected when bubbles are present in the pressure chambers 86 and the nozzles 24 that are filled with the liquid is higher than the frequency of an oscillatory waveform detected when no bubbles are present in the pressure chambers 86 and the nozzles 24 that are filled with the liquid. The frequency of an oscillatory waveform detected when the pressure chambers 86 and the nozzles 24 are filled with air is higher than the frequency of an oscillatory waveform detected when bubbles present in the pressure chambers 86 and the nozzles 24 that are filled with the liquid. As the sizes of bubbles in the pressure chambers 86 and the nozzles 24 that are filled with the liquid increase, the frequency of the oscillatory waveform increases.

The control portion 111 may determine whether the filter 84 is in a normal condition based on a detection result from the ejection state detector 113. A clogged filter 84 may weaken the flow of the liquid passing through the filter 84. The weakened liquid flow tends to cause air mixing from the nozzles 24, resulting in bubble accumulation in the pressure chambers 86. Accordingly, the control portion 111 may determine that the filter 84 is in an abnormal condition based on a detected abnormal condition due to bubbles in the pressure chambers 86.

More specifically, the control portion 111 may determine that the filter 84 is in an abnormal condition when, among the pressure chambers 86, the number of pressure chambers 86 in abnormal conditions due to bubbles exceeds a predetermined number. The predetermined number is, for example, the number of pressure chambers 86 that are not covered by complement printing, by which the liquid to be ejected from abnormal nozzles is covered by the liquid ejected from adjacent nozzles 24.

Figure 9:
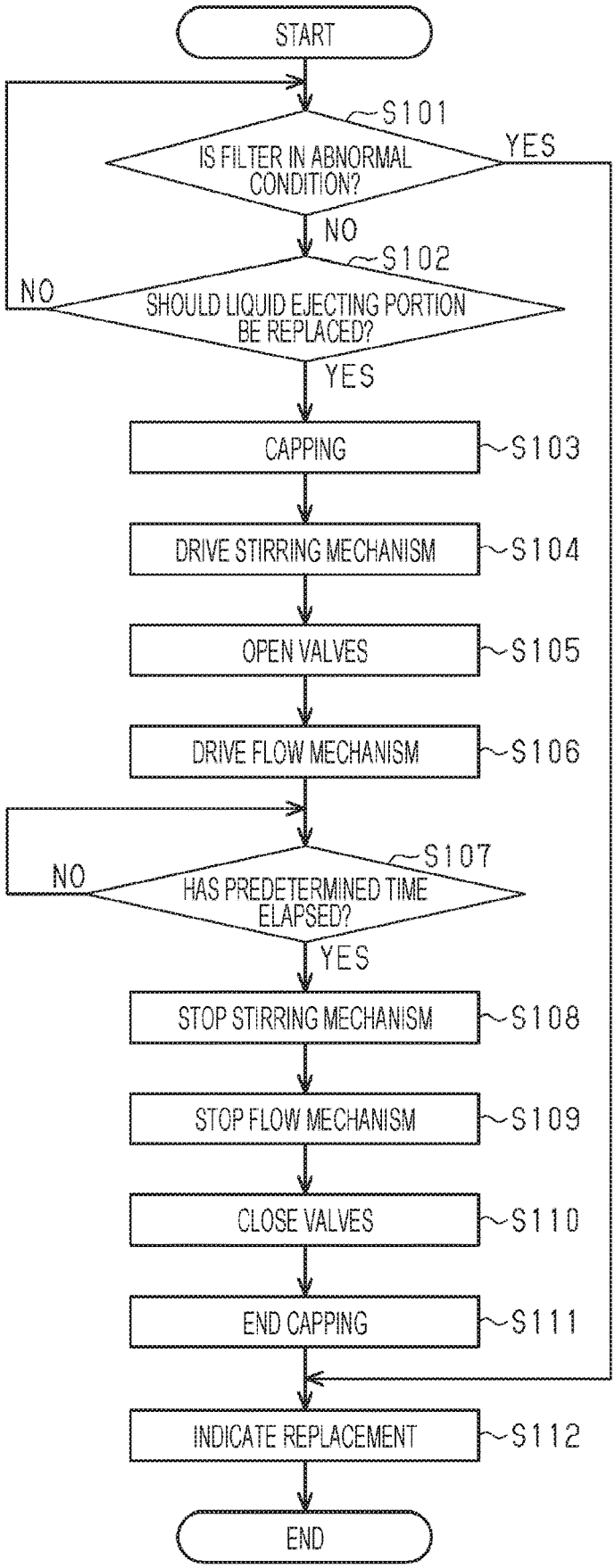
FIG. 9 is a flowchart illustrating a replacement routine.

Next, a method for maintaining the liquid ejecting apparatus 11 will be described. The replacement routine illustrated in FIG. 9 is performed when the power of the liquid ejecting apparatus 11 is turned on. As illustrated in FIG. 9, in step S101, the control portion 111 determines whether the filter 84 is in an abnormal condition. In step S101, when the filter 84 is in an abnormal condition, the result of step S101 becomes YES. Then, the control portion 111 goes to the processing in step S112. When the filter 84 is not in an abnormal condition, the result of step S101 becomes NO, and the control portion 111 goes to the processing in step S102.

In step S102, the control portion 111 determines whether to replace the liquid ejecting portion 15. For example, when no information for replacing the liquid ejecting portion 15 is input through an input portion (not illustrated) of the computer 120 or the liquid ejecting apparatus 11, the result of step S102 becomes NO, and the control portion 111 goes to the processing in step S101. When information for replacing the liquid ejecting portion 15 is input, the result of step S102 becomes YES, and the control portion 111 goes to the processing in step S103.

In step S103, the control portion 111 performs capping to the liquid ejecting portion 15. In step S104, the control portion 111 drives the stirring mechanism 43 to stir the liquid in the storage portion 32.

In step S105, the control portion 111 opens the valves in the circulation flow channel 33. In step S106, the control portion 111 drives the flow mechanism 39. More specifically, the control portion 111 opens the supply valve 46, the first replacement valve 97*a*, the second replacement valve 97*b*, the first return valve 99*a*, and the second return valve 99*b*, and drives the supply pump 39A and the return pump 39B.

In step S107, the control portion 111 determines whether a predetermined time has elapsed since the driving of the flow mechanism 39. The predetermined time is a time required to collect foreign matter or bubbles in the circulation flow channel 33 into the filter 84. When the predetermined time has not elapsed, the result of step S107 becomes NO, and the control portion 111 stands by until the predetermined time elapses. After the predetermined time has elapsed, the result of step S107 becomes YES, and the control portion 111 goes to the processing in step S108.

In step S108, the control portion 111 stops the driving of the stirring mechanism 43. In step S109, the control portion 111 stops the driving of the flow mechanism 39. In step S110, the control portion 111 closes the valves that have been opened in step S106. In step S111, the control portion 111 ends the capping. In step S112, the control portion 111 informs the user that the liquid ejecting portion 15 should be replaced, and ends the replacement routine.

The operations according to the embodiment will be described. As illustrated in FIG. 2, when the control portion 111 determines that the filter 84 is in a normal condition and the liquid ejecting portion 15 is in an abnormal ejection condition based on a detection result from the ejection state detector 113, the control portion 111 may cause the liquid to flow before the liquid ejecting portion 15 is replaced. More specifically, in the replacement of the liquid ejecting portion 15, the control portion 111 drives the flow mechanism 39 to cause the liquid to flow in the liquid supply flow channel 30 toward the liquid ejecting portion 15.

The liquid flows in the supply direction A in the liquid supply flow channel 30 from the storage portion 32 toward the liquid ejecting portion 15. The liquid supplied to the liquid ejecting portion 15 passes through the filter 84 through the first return flow channel 31*a* and the second return flow channel 31*b* from the liquid ejecting portion 15 toward the storage portion 32 in the return direction B. More specifically, the liquid supplied to the liquid ejecting portion 15 flows in the return direction B through the common liquid chamber 85, the pressure chamber 86, the discharge liquid chamber 93, the first discharge flow channel 91, and the first return flow channel 31*a*. The liquid supplied to the liquid ejecting portion 15 flows in the return direction B through the common liquid chamber 85, the second discharge flow channel 92, and the second return flow channel 31*b*.

In the replacement of the liquid ejecting portion 15, the control portion 111 may drive the stirring mechanism 43 to cause the stirred liquid in the storage portion 32 to flow. The driven stirring mechanism 43 causes foreign matter in the storage portion 32 to move together with the liquid flowing through the circulation flow channel 33. The control portion 111 may cause the liquid to flow with the nozzle surface 25 being capped by the maintenance section 79.

After the control portion 111 drives the flow mechanism 39 to collect foreign matter in the circulation flow channel 33 into the filter 84, the control portion 111 may cause the liquid supply flow channel 30 to communicate with the air flow channel 44*b*. The control portion 111 may drive the return pump 39B with the liquid supply flow channel 30 and the air flow channel 44*b* communicating with each other to take air into the liquid supply flow channel 30. In this operation, the control portion 111 may open the storage release valve 41. The air sent to the storage portion 32 may be released to the outside through the storage release valve 41. The control portion 111 may collect the liquid in the circulation flow channel 33 into the storage portion 32 and then may allow the replacement of the liquid ejecting portion 15.

After the liquid in the circulation flow channel 33 has been collected in the storage portion 32, the control portion 111 stops the driving of the flow mechanism 39 and closes the supply valve 46, the first replacement valve 97*a*, and the second replacement valve 97*b*. The control portion 111 switches the switching valve 44*a* such that the liquid supply flow channel 30 and the air flow channel 44*b* do not communicate with each other. In this state, the control portion 111 informs the user that the liquid ejecting portion 15 should be replaced.

The liquid ejecting portions 15 are detached from the liquid ejecting portion holding portion 27 by disconnecting the supply connector 45 to separate the liquid supply flow channel 30, and disconnecting the first return connector 96*a* and the second return connector 96*b* to separate the liquid ejecting portions 15 and the liquid return flow channel 31.

Advantages of the embodiment will be described.

1. The liquid supply flow channel 30 is coupled to the liquid ejecting portion 15 and constitutes the circulation flow channel 33 together with the liquid return flow channel 31. In the replacement of the liquid ejecting portion 15, the control portion 111 drives the flow mechanism 39 to cause the liquid in the circulation flow channel 33 to flow. More specifically, the liquid flows in the liquid supply flow channel 30 toward the liquid ejecting portion 15, passes through the filter 84 in the liquid ejecting portion 15, and returns through the liquid return flow channel 31 to the liquid supply flow channel 30. Accordingly, foreign matter staying in the liquid supply flow channel 30 can be efficiently collected into the filter 84 in the liquid ejecting portion 15 to be replaced.

2. In the replacement of the liquid ejecting portion 15, the control portion 111 drives the stirring mechanism 43. The driven stirring mechanism 43 causes foreign matter in the storage portion 32 to flow together with the liquid. Accordingly, the foreign matter staying in the storage portion 32 can be efficiently collected into the filter 84 in the liquid ejecting portion 15 to be replaced.

3. The control portion 111 causes the liquid to flow with the nozzle surface 25 being capped by the cap 80. More specifically, the control portion 111 causes the cap 80 to come into contact with the nozzle surface 25 to flow the liquid with the nozzles 24 being capped by the maintenance section 80. Accordingly, when the liquid supplied toward the liquid ejecting portion 15 leaks from the liquid ejecting portion 15, the leaked liquid can be prevented from splashing around.

4. If the liquid is forced to flow with the filter 84 in an abnormal condition such as clogging, a load may be applied to the flow mechanism 39 and/or the liquid supply flow channel 30. To solve the problem, when the control portion 111 determines that the filter 84 is in a normal condition and the liquid ejecting portion 15 is in an abnormal ejection condition based on a detection result from the ejection state detector 113, the control portion 111 causes the liquid to flow. Accordingly, it can be prevented that a large load is applied to the flow mechanism 39 and/or the liquid supply flow channel 30.

Second Embodiment

Hereinafter, a liquid ejecting apparatus and a method of maintaining the liquid ejecting apparatus according to a second embodiment will be described with reference to the attached drawings. The second embodiment is different from the first embodiment in that the liquid ejecting apparatus is a line-type apparatus. The other structures are similar to those in the first exemplary embodiment, and thus the same reference numerals are given to similar components to omit their overlapping descriptions.

Figure 10:
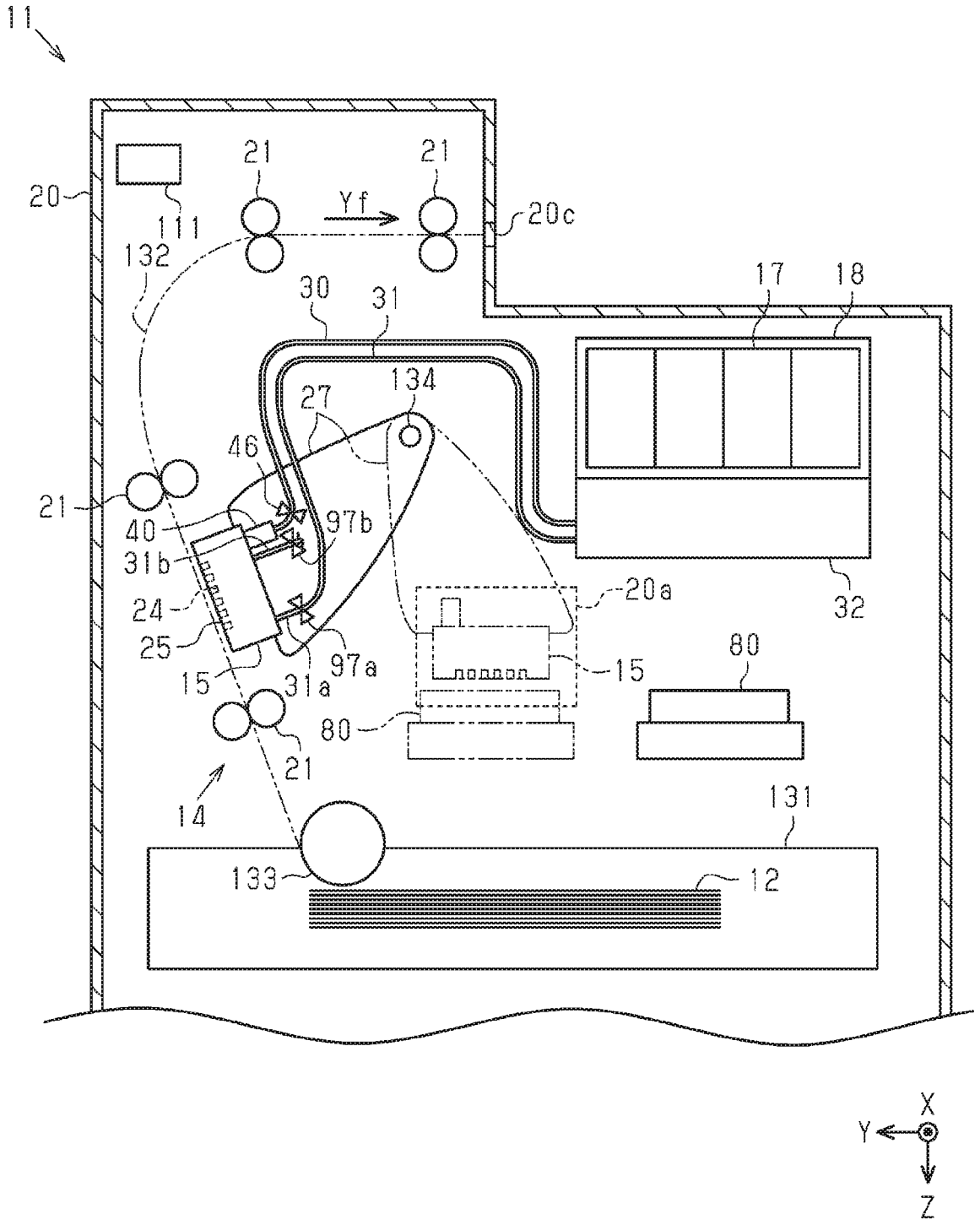
FIG. 10 is a side view schematically illustrating a liquid ejecting apparatus according to a second embodiment.

As illustrated in FIG. 10, the liquid ejecting apparatus 11 may include a cassette 131 that stores a medium 12 in a stacked manner. The cassette 131 may be provided such that the cassette 131 can be pulled out from the body 20. The liquid ejecting apparatus 11 has a transport path 132 that extends from the cassette 131 to a discharge port 20*c* indicated by the chain double-dashed line in FIG. 10. The transport section 14 transports the medium 12 along the transport path 132. The transport section 14 may include a pickup roller 133 that feeds an uppermost medium 12 in the medium 12 stored in the cassette 131. In the transport section 14, a medium 12 that is fed by the pickup roller 133 is transported in a transport direction Yf by a plurality of transport roller pairs 21.

The liquid ejecting portion 15 according to the embodiment is a line head that can simultaneously discharge a liquid in a width direction of the medium 12. The liquid ejecting portion holding portion 27 may be rotated about a rotation shaft 134. The liquid ejecting portion 15 that is located in a maintenance position indicated by the chain double-dashed line in FIG. 10 is moved in the clockwise direction in FIG. 10 to a print position indicated by the solid line in FIG. 10. The liquid ejecting portion 15 that is located in the print position is moved in the counterclockwise direction in FIG. 10 to return to the maintenance position.

The liquid ejecting portion 15 that is in the print position is located in a print orientation such that the nozzle surface 25 is inclined with respect to a horizontal plane. In the print orientation, the liquid ejecting portion 15 ejects the liquid from the nozzles 24 onto the medium 12 for printing. The liquid ejecting apparatus 11 ejects the liquid in a direction perpendicular to the nozzle surface 25, and accordingly, the direction in which the liquid ejecting portion 15 ejects the liquid for printing is different from the vertical direction Z.

In the liquid ejecting portion 15 in the print orientation, the first return flow channel 31*a* may be coupled to a portion lower than the second return flow channel 31*b* in the vertical direction Z. More specifically, in the print orientation, the first discharge flow channel 91 may be located at a position lower than the second discharge flow channel 92 in the vertical direction Z.

The liquid ejecting portion 15 that is in the maintenance position is located in a maintenance orientation in which the nozzle surface 25 having the nozzles 24 is oriented to be closer to horizontal than the print orientation. In the maintenance orientation, the nozzle surface 25 may be aligned substantially parallel to the horizontal plane. That is, the nozzle surface 25 may be arranged along the horizontal plane. The cap 80 performs capping to the liquid ejecting portion 15 in the maintenance orientation.

The operations according to the embodiment will be described. In the replacement of the liquid ejecting portion 15, the control portion 111 may drive the flow mechanism 39 to flow the liquid in a state in which the maintenance is ready. The control portion 111 may control the liquid ejecting portion 15 to the maintenance orientation and cause the liquid to flow with the nozzle surface 25 being capped by the maintenance section 79. The user replaces the liquid ejecting portion 15 in the maintenance orientation through which the liquid flowed, for example, by opening the first cover 20*a* that is disposed in a side surface of the body 20.

Advantages of the embodiment will be described.

5. The control portion 111 causes the liquid to flow with the maintenance section 79 ready for the maintenance for the liquid ejecting portion 15. With this operation, if the liquid supplied toward the liquid ejecting portion 15 leaks from the liquid ejecting portion 15, the maintenance section 79 can receive the liquid. Accordingly, the inside of the liquid ejecting apparatus 11 is less soiled.

The embodiments may be modified and implemented as follows. The embodiments and the following modifications may be combined with each other within a technically consistent scope.

When the number of abnormal nozzles that are not recovered by the maintenance is a predetermined number or more, the control portion 111 may inform the user that the liquid ejecting portion 15 should be replaced, and cause the liquid to flow in the liquid supply flow channel 30 toward the liquid ejecting portion 15.

In step S106, the control portion 111 may open the supply valve 46, the first replacement valve 97*a*, the second replacement valve 97*b*, the first return valve 99*a*, and the second return valve 99*b*, and drive the return pump 39B that serves as the flow mechanism 39.

In step S106, the control portion 111 may open the supply valve 46, the first replacement valve 97*a*, and the first return valve 99*a*, and drive the return pump 39B that is disposed in the first return flow channel 31*a* and serves as the flow mechanism 39. In step S106, the control portion 111 may open the supply valve 46, the second replacement valve 97*b*, and the second return valve 99*b*, and drive the return pump 39B that is disposed in the second return flow channel 31*b* and serves as the flow mechanism 39.

The control portion 111 may drive the flow mechanism 39 during printing to cause the liquid in the circulation flow channel 33 to flow. During the printing, the liquid ejecting portion 15 faces the medium 12. Accordingly, the liquid circulation during the printing is performed without capping.

The control portion 111 may drive the stirring mechanism 43 before driving the flow mechanism 39 or may drive the flow mechanism 39 and then drive the stirring mechanism 43.

The stirring mechanism 43 may be disposed at a position different from the storage portion 32. For example, in the liquid supply section 19, a stirring chamber that houses the stirring member 43*a* may be disposed in the liquid supply flow channel 30.

The liquid ejecting apparatus 11 may not include the pressure regulator 40. In such a case, the control portion 111 may cause the liquid in the liquid supply flow channel 30 to flow toward the liquid ejecting portion 15 by the drive of the supply pump 39A.

The liquid ejecting apparatus 11 may not include the pressing mechanism 49. In such a case, the control portion 111 may cause the liquid in the liquid supply flow channel 30 to flow toward the liquid ejecting portion 15 by the drive of the maintenance section 79 or the return pump 39B to form a negative pressure in the liquid ejecting portion 15.

The liquid ejecting apparatus 11 may not include the liquid return flow channel 31. The control portion 111 may cause the liquid in the liquid supply flow channel 30 to flow toward the liquid ejecting portion 15 by forming a negative pressure in the liquid ejecting portion 15 in a capped state to discharge the liquid from the nozzles 24.

The pressure regulator 40 may be detachably attached to the liquid ejecting portion 15.

The filter 84 may be detachably attached to the liquid ejecting portion 15. When the control portion 111 determines that the filter 84 is in an abnormal condition, the control portion 111 may inform the user that the filter 84 should be replaced. The filter 84 may be replaced from a replacement port that is covered by the same first cover 20*a* that covers the liquid ejecting portion 15.

The liquid ejecting apparatus 11 may include a plurality of filter units 38. In the liquid return flow channel 31, the filter units 38 may be detachably attached to the liquid return flow channel 31. In the liquid supply flow channel 30 between the pressure regulator 40 and the liquid ejecting portion 15, the filter units 38 may be detachably attached to the liquid supply flow channel 30.

The liquid ejecting portion 15 may include a storage portion that stores information. The storage portion may store information about the filter 84 such as an amount of liquid passed through the filter 84. Based on the amount of liquid passed through the filter 84, the control portion 111 may determine whether the filter 84 is clogged.

The liquid ejecting portion 15 may heat the liquid in the pressure chambers 86 with an electrothermal conversion element such as a heater to cause film boiling such that the liquid is ejected from the nozzles 24. In such a case, the ejection state detecting portion 113 may compare a highest temperature in liquid ejection detected by a temperature detection element disposed under the heater with a predetermined threshold or may detect an ejection state from a temperature difference. The ejection state detecting portion 113 may detect an ejection state by flight detection by using an optical element. The control portion 111 may determine an ejection state of the liquid in the liquid ejecting portion 15 based on a combination of a result of the detection of a state inside the pressure chamber 86 and a result of a flight detection by using an optical element.

The control portion 111 may cause the liquid to flow in the liquid supply flow channel 30 with the cap 80 facing the nozzle surface 25 and being located at a position away from the nozzle surface 25. Since the cap 80 is facing the nozzle surface 25, if the liquid leaks from the nozzles 24 due to the flow of the liquid in the liquid supply flow channel 30, the leaked liquid can be received by the cap 80.

The liquid ejecting apparatus 11 may be a liquid ejecting apparatus that ejects or discharges liquid other than ink. The state of the liquid discharged as a minute amount of droplets from the liquid ejecting apparatus includes granular droplets, tear droplets, or stringy droplets. The liquid may be any material that can be discharged from the liquid discharge apparatus. For example, the liquid may be any material in a liquid phase, including a liquid having high or low viscosity, or a fluid material such as sol, gel water, other inorganic solvents, an organic solvent, a solution, a liquid resin, a liquid metal, or a metal melt. The liquid is not limited to liquid that is in one state of a material but includes a liquid in which particles of a functional material composed of a solid material such as a pigment or metal particles are dissolved, dispersed, or mixed in a solvent. Typical examples of the liquid include an ink like that described in the above embodiments, liquid crystal, and the like. The ink may be inks that contain various kinds of liquid compositions, such as general water-based inks, oil-based inks, gel inks, hot melt inks, and the like. The liquid ejecting apparatus may be, for example, a liquid ejecting apparatus that discharges a liquid containing a dispersed or dissolved material such as an electrode material or a color material to be used for manufacturing liquid crystal displays, electroluminescence (EL) displays, field emission displays (FEDs), or color filters. Furthermore, the liquid ejecting apparatus may be an apparatus that discharges a bioorganic material to be used for biochip manufacture, an apparatus that is used as a precision pipette and discharges a liquid that is used as a sample, a textile printing apparatus, a micro dispenser, or the like. Furthermore, the liquid ejecting apparatus may be an apparatus that discharges lubricating oil with pinpoint precision onto a precision machine such as a watch, a camera, or the like, or an apparatus that discharges a transparent resin liquid such as an ultraviolet curing resin onto a substrate to form a micro hemispherical lens, an optical lens, or the like to be used for an optical communication element or the like. Furthermore, the liquid ejecting apparatus may be an apparatus that discharges an etching solution such as acid or alkali to etch a substrate or the like.

Technical ideas grasped from the above-described embodiments and modifications and their effects will be described below.

A. A liquid ejecting apparatus includes a liquid ejecting portion having a filter configured to filter a supplied liquid and eject the liquid filtered by the filter from nozzles, a liquid ejecting portion holding portion replaceably holding the liquid ejecting portion, a liquid supply flow channel coupled to the liquid ejecting portion so as to supply the liquid to the liquid ejecting portion, a liquid return flow channel coupled to the liquid ejecting portion, the liquid return flow channel constituting a circulation flow channel together with the liquid supply flow channel, a flow mechanism configured to flow the liquid in the circulation flow channel, and a control portion configured to drive the flow mechanism to cause the liquid to flow in the liquid supply flow channel toward the liquid ejecting portion the replacement of the liquid ejecting portion.

With the structure, a liquid supply flow channel is coupled to a liquid ejecting portion and constitutes a circulation flow channel together with a liquid return flow channel. In the replacement of the liquid ejecting portion, a control portion drives a flow mechanism to cause the liquid in the circulation flow channel to flow. More specifically, the liquid flows through the liquid supply flow channel toward the liquid ejecting portion, passes through a filter in the liquid ejecting portion, and returns through the liquid return flow channel to the liquid supply flow channel. Accordingly, foreign matter staying in the liquid supply flow channel can be efficiently collected into the filter in the liquid ejecting portion to be replaced.

B. The liquid ejecting apparatus may include a storage portion coupled to the liquid supply flow channel and the liquid return flow channel to constitute the circulation flow channel, and a stirring mechanism configured to stir the liquid in the storage portion. In the replacement of the liquid ejecting portion, the control portion may drive the stirring mechanism to cause the stirred liquid in the storage portion to flow.

With this structure, in the replacement of the liquid ejecting portion, the control portion drives the stirring mechanism. The driven stirring mechanism makes a greater amount of foreign matter in the storage portion to flow together with the liquid. Accordingly, the foreign matter staying in the storage portion can be efficiently collected into the filter in the liquid ejecting portion to be replaced.

C. The liquid ejecting apparatus may include a maintenance portion configured to perform maintenance of the liquid ejecting portion that is in a maintenance orientation in which a nozzle surface having the nozzles is closer to horizontal than a print orientation for the liquid ejecting portion to eject the liquid from the nozzles onto a medium for printing. In the replacement of the liquid ejecting portion, the control portion may cause the liquid to flow in a state in which the maintenance is ready.

With this structure, the control portion causes the liquid to flow with the maintenance portion ready for the maintenance for the liquid ejecting portion. With this operation, if the liquid supplied toward the liquid ejecting portion leaks from the liquid ejecting portion, the maintenance portion can receive the liquid. Accordingly, the inside of the liquid ejecting apparatus is less soiled.

D. In the liquid ejecting apparatus, the maintenance portion may include a cap configured to perform capping to the nozzle surface of the liquid ejecting portion. In the replacement of the liquid ejecting portion, the control portion may cause the liquid to flow with the nozzle surface being capped by the maintenance portion.

With this structure, the control portion causes the liquid to flow with the nozzle surface being capped by the cap. More specifically, the control portion causes the cap to come into contact with the nozzle surface to flow the liquid with the nozzles being capped by the maintenance section.

Accordingly, if the liquid supplied toward the liquid ejecting portion leaks from the liquid ejecting portion, the leaked liquid can be prevented from splashing around.

E. The liquid ejecting apparatus may include an ejection state detecting portion configured to detect an ejection state of the liquid in the liquid ejecting portion. When the control portion determines that the filter is in a normal condition and the liquid ejecting portion is in an abnormal ejection condition based on a detection result from the ejection state detection portion, the control portion may cause the liquid to flow before the liquid ejecting portion is replaced.

For example, if the liquid is forced to flow with the filter in an abnormal condition such as clogging, a load may be applied to the flow mechanism and/or the liquid supply flow channel. To solve the problem, in this structure, when the control portion determines that the filter is in a normal condition and the liquid ejecting portion is in an abnormal ejection condition based on a detection result from the ejection state detector, the control portion causes the liquid to flow. Accordingly, it can be prevented that a large load is applied to the flow mechanism and/or the liquid supply flow channel.

F. A method of maintaining a liquid ejecting apparatus including a liquid ejecting portion having a filter configured to filter a supplied liquid and eject the liquid filtered by the filter from nozzles and a liquid supply flow channel coupled to the liquid ejecting portion so as to supply the liquid to the liquid ejecting portion is provided. The method includes causing the liquid to flow in the liquid supply flow channel toward the liquid ejecting portion in replacement of the liquid ejecting portion.

According to the method, effects similar to those in the above-described liquid ejecting apparatus can be achieved.

G. The liquid ejecting apparatus maintenance method may include, in the replacement of the liquid ejecting portion with the filter being in a normal condition, causing the liquid to flow.

According to the method, effects similar to those in the above-described liquid ejecting apparatus can be achieved.

H. In the liquid ejecting apparatus maintenance method, the liquid ejecting apparatus may include a liquid return flow channel coupled to the liquid ejecting portion, the liquid return flow channel constituting a circulation flow channel together with the liquid supply flow channel, and a storage portion configured to store the liquid, the storage portion being coupled to the liquid supply flow channel and the liquid return flow channel to constitute the circulation flow channel. The method may include, in the replacement of the liquid ejecting portion, causing the liquid that is stirred in the storage portion to flow.

According to the method, effects similar to those in the above-described liquid ejecting apparatus can be achieved.

I. In the liquid ejecting apparatus maintenance method, the liquid ejecting apparatus may include a maintenance portion configured to perform maintenance of the liquid ejecting portion that is in a maintenance orientation in which a nozzle surface having the nozzles is closer to horizontal than a print orientation for the liquid ejecting portion to eject the liquid from the nozzles onto a medium for printing. The method may include, in the replacement of the liquid ejecting portion, causing the liquid to flow in a state in which the maintenance is ready.

According to the method, effects similar to those in the above-described liquid ejecting apparatus can be achieved.

J. In the liquid ejecting apparatus maintenance method, the maintenance portion may include a cap configured to perform capping to the nozzle surface of the liquid ejecting portion. The method may include, in the replacement of the liquid ejecting portion, causing the liquid to flow with the nozzle surface being capped.

According to the method, effects similar to those in the above-described liquid ejecting apparatus can be achieved.

What is claimed is:

1. A liquid ejecting apparatus comprising:

a liquid ejecting portion having a filter configured to filter a supplied liquid and eject the liquid filtered by the filter from nozzles;

a liquid ejecting portion holding portion replaceably holding the liquid ejecting portion;

a liquid supply flow channel coupled to the liquid ejecting portion so as to supply the liquid to the liquid ejecting portion;

a liquid return flow channel coupled to the liquid ejecting portion, the liquid return flow channel constituting a circulation flow channel together with the liquid supply flow channel;

a flow mechanism configured to flow the liquid in the circulation flow channel;

a control portion configured to drive the flow mechanism to cause the liquid to flow in the liquid supply flow channel toward the liquid ejecting portion; wherein in the case of replacing the liquid ejecting portion, before replacing the liquid ejecting portion, the control portion drives the flow mechanism and flows the liquid in the liquid supply flow channel toward the liquid ejecting portion.

2. The liquid ejecting apparatus according to claim 1, further comprising:

a storage portion configured to store the liquid, the storage portion being coupled to the liquid supply flow channel and the liquid return flow channel to constitute the circulation flow channel; and a stirring mechanism configured within the storage portion and configured to stir the liquid in the storage portion, wherein in the case of replacing the liquid ejecting portion, the control portion is configured to drive the stirring mechanism to cause the stirred liquid in the storage portion to flow.

3. The liquid ejecting apparatus according to claim 1, further comprising:

a maintenance portion configured to perform maintenance of the liquid ejecting portion that is in a maintenance orientation in which a nozzle surface having the nozzles is closer to horizontal than a print orientation for the liquid ejecting portion to eject the liquid from the nozzles onto a medium for printing, wherein in the case of replacing the liquid ejecting portion, the control portion is configured to cause the liquid to flow in a state in which the maintenance is ready.

4. The liquid ejecting apparatus according to claim 1, wherein the maintenance portion includes a cap configured to perform capping to the nozzle surface of the liquid ejecting portion, wherein in the case of replacing the liquid ejecting portion, the control portion is configured to cause the liquid to flow with the nozzle surface being capped by the maintenance portion.

5. The liquid ejecting apparatus according to claim 1, further comprising:

an ejection state detecting portion configured to detect an ejection state of the liquid in the liquid ejecting portion, wherein when the control portion determines that the filter is in a normal condition and the liquid ejecting portion is in an abnormal ejection condition based on a detection result from the ejection state detection portion, the control portion causes the liquid to flow before the liquid ejecting portion is replaced.

* * * * *